US007055822B2

(12) United States Patent
Lo

(10) Patent No.: US 7,055,822 B2
(45) **Date of Patent: *Jun. 6, 2006**

(54) CARD GAME

(76) Inventor: Henry Tien Lo, 5010 Indian River Dr., #32, Las Vegas, NV (US) 89103

( * ) Notice: Subject to any disclaimer, the term of this patent is extended or adjusted under 35 U.S.C. 154(b) by 0 days.

This patent is subject to a terminal disclaimer.

(21) Appl. No.: 11/010,080

(22) Filed: Dec. 10, 2004

(65) Prior Publication Data

US 2005/0087929 A1 Apr. 28, 2005

Related U.S. Application Data

(63) Continuation-in-part of application No. 09/823,571, filed on Mar. 29, 2001, now Pat. No. 6,830,247.

(51) Int. Cl.
*A63F 1/00* (2006.01)

(52) U.S. Cl. ..... 273/292; 273/274

(58) Field of Classification Search ..... 273/292
See application file for complete search history.

(56) References Cited

U.S. PATENT DOCUMENTS 5,275,415 A * 1/1994 Wisted ..... 273/274
5,294,128 A * 3/1994 Marquez ..... 273/292
5,735,524 A * 4/1998 Wisted ..... 273/274
5,810,361 A * 9/1998 Kadlic ..... 273/292
5,863,042 A * 1/1999 Lo ..... 273/292
5,984,310 A * 11/1999 English ..... 273/292
5,995,022 A * 11/1999 Plis et al. ..... 340/870.02
6,012,374 A * 1/2000 Brandl et al. ..... 89/1.41
6,102,402 A * 8/2000 Scott et al. ..... 273/292
6,575,465 B1 * 6/2003 Lo ..... 273/292
6,830,247 B1 * 12/2004 Lo ..... 273/292

* cited by examiner

*Primary Examiner*—Eugene Kim
*Assistant Examiner*—Dolores R. Collins
(74) *Attorney, Agent, or Firm*—Gerry J. Elman; Elman Technology Law, P.C.

(57) ABSTRACT

The invention is a six-card-stud poker game. A Player who is not a Banker may play Poker Bet playing against a Banker's hand, and/or one or up to seven side bets betting on the contents of the Player's own hand. From their six dealt cards, every Player and the Banker each then selects and keeps his best 5-card poker hand and discards one card. A Player's Poker Bet wager wins if the Player is dealt a hand of six-card 8 high or six-card Straight Flush, or if the Player's best 5-card poker hand ranks the same as or higher than the Banker's best 5-card poker hand. A Player's side-bet wager wins a Player's best 5-card poker hand is one of predetermined winning hands of the type of the side bet he bets on. The Poker Bet wager and seven side-bet wagers are eight independent wagers and are settled separately.

17 Claims, 3 Drawing Sheets

Five Bets Version of 2 Jokers Wild 6 Card Thrill

CARD GAME

CROSS REFERENCE TO RELATED APPLICATION

This application is a continuation-in-part of application Ser. No. 09/823,571, filed Mar. 29, 2001, now U.S. Pat. No. 6,830,247.

FIELD OF THE INVENTION

The present invention generally relates to card games and, in particular, to card games for use in casinos and cardrooms. The present invention is an improved version of the U.S. non-provisional patent application Ser. No. 09/823.571. It provides players (none of them is a banker) new exciting twists such as in the Poker Bet game, the Player's Poker Bet wager can also win if the Player is dealt a six-card 8 high hand or a six-card Straight Flush, or if the Player's best 5-card poker hand ranks the same as the Banker's best 5-card poker hand; and the Player's side-bet wager can also win if the Player's best 5-card poker hand is a 8-high hand. With added new twists the game, players can enjoy the game even more.

BRIEF DESCRIPTION OF THE INVENTION

The present invention is offered under the trademark of "2 Jokers Wild 6 Card Thrill." The present invention is a six-card-stub poker game, played with at least one but preferably one standard poker decks of 52 cards, plus at least one but preferably two Jokers. Each Joker can be used as any card. Two or more but preferably seven players may participate in the game. One of the players is the Banker whom other players play against. A Player who is not a Banker may play Poker Bet playing against the Banker's hand, and/or one or more side bets betting on the contents of the Player's own hand. After at least one wager is placed, each Player and the Banker are each dealt six cards. From each Player's own six cards, each Player selects and keeps his or her best 5-card poker hand and discards one other card; i.e., from the Player's six dealt cards QQK975, QQK97 is the Player's best 5-card poker hand and 5 is the discard. From the Banker's own six cards, the Banker selects and keeps the Banker's best 5-card poker hand and discards one other card.

POKER BET is a bet that allows a Player to place a wager playing against the Banker's hand. The object of Poker Bet game is to have a best 5-card poker hand that ranks the same as or higher than the Banker's best 5-card poker hand. In the game, the Player's best 5-card poker hand is compared to the Banker's best 5-card poker hand according to traditional poker rankings, wherein hands are ranked in descending order as follows: Royal Flush, 5 of a Kind, Straight Flush, 4 of a Kind, Full House, Flush, Straight, 3 of a Kind, Two Pair, One Pair and High Card. Ace is the highest High Card, following by King, Queen, Jack, Ten, 9, 8, 7, 6, 5, 4, 3 and 2. A2345 is the lowest Straight.

A Poker Bet wager can be settled with either one of the following rules, whichever is selected for the game:

Rules 1: If the Player is dealt a 6-card Straight Flush or a 6-card 8 high hand the Player's wager wins Even Money (1 to 1) regardless of the Banker's hand. If the Player is not dealt a 6-card Straight Flush or a 6-card 8 high hand, then the Player's wager is settled as follows: if the Player's best 5-card poker hand ranks the same as or higher than the Banker's best 5-card poker hand, then the Player's wager wins and, either is paid Even Money (1 to 1) if the Banker's losing hand is not King-Jack or lower or is paid one half of the wager (1 to 2) if the Banker's losing hand is King-Jack or lower; if the Player's best 5-card poker hand ranks lower than the Banker's, the Player's Poker Bet wager loses.

Rules 2: If the Player is dealt a 6-card Straight Flush or a 6-card 8 high hand, the Player's wager wins Even Money (1 to 1) regardless of the Banker's hand. If the Player is not dealt a 6-card Straight Flush or a 6-card 8 high hand, then the Player's wager is settled as follows: if the Player's best 5-card poker hand ranks the same as or higher than the Banker's best 5-card poker hand, then the Player's wager wins and, either is paid Even Money (1 to 1) if the Banker's losing hand is not one of the predetermined hands that pays the Player's winning hand one half of the wager or is paid one half of the wager (1 to 2) if the Banker's losing hand is one of the predetermined hands that pays the Player winning hand one half of the wager; if the Player's best 5-card poker hand ranks lower than the Banker's, the Player's Poker Bet wager loses.

Rules 3: If the Player is dealt a 6-card Straight Flush or a 6-card 8 high hand the Player's wager wins Even Money (1 to 1) regardless of the Banker's hand. If the Player is not dealt a 6-card Straight Flush or a 6-card 8 high hand, then the Player's wager is settled as follows: if the Player's best 5-card poker hand ranks the same as or higher than the Banker's best 5-card poker hand, then the Player's wager wins and is paid Even Money (1 to 1) less a 5% commission; if the Player's best 5-card poker hand ranks lower than the Banker's, this wager loses.

Rules 4: If the Player is dealt a 6-card Straight Flush or a 6-card 8 high hand the Player's wager wins Even Money (1 to 1) regardless of the Banker's hand. If the Player is not dealt a 6-card Straight Flush or a 6-card 8 high hand, then the Player's wager is settled as follows: if the Banker's best 5-card poker hand is 'not' one of predetermined qualifying hands, the Player's wager is a tie and the Player's wager neither wins nor loses; if the Player's best 5-card poker hand ranks the same as or higher than the Banker's best 5-card poker hand and the Banker's best 5-card poker hand is one of the predetermined qualifying hands, then the Player's wager wins and is paid Even Money (1 to 1); and if the Player's best 5-card poker hand ranks lower than the Banker's and the Banker's best 5-card poker hand is one of the predetermined qualifying hands, this wager loses.

Rules 5: If the Player is dealt a 6-card Straight Flush or a 6-card 8 high hand the Player's wager wins Even Money (1 to 1) regardless of the Banker's hand. If the Player is not dealt a 6-card Straight Flush or a 6-card 8 high hand, then the Player's wager is settled as follows: if the Player's best 5-card poker hand ranks the same as or higher than the Banker's best 5-card poker hand and the Banker's best 5-card poker hand is one of the predetermined qualifying hands, this wager wins and is paid Even Money (1 to 1); if the Player's best 5-card poker hand ranks the same as or higher than the Banker's, the Banker's best 5-card poker hand is 'not' one of predetermined qualifying hands, then the Player's wager wins and is paid one half of the wager; if the Player's best 5-card poker hand ranks lower than the Banker's and the Banker's best 5-card poker hand is one of the predetermined qualifying hands, the Player's wager loses THE SIDE BETS OF THE INVENTION: Side Bets are bets that allow Players to bet on the contents of their own hand. A Player's side-bet wager wins if the Player's best 5-card poker hand is one of the predetermined winning hands of the type of side bet he or she bets on, regardless of the outcome of the Poker Bet wager or the Banker's hand; and this wager loses if the Player's best 5-card poker hand is not one of the predetermined winning hands. There are seven side bets and they are: Pair of Kings Or Better Bet, Two Pair Or Better Bet, 3 Of A Kind Or Better Bet, Straight Or Better Bet, Flush Or Better Bet, Full House Or Better Bet and Bonus Bet.

PAIR OF KINGS OR BETTER BET: A Player's Pair Of Kings Or Better Bet wager wins if the Player's best 5-card poker hand is a 8-high hand, a pair of Kings, a pair of Aces, Two Pair, 3 of a Kind, Straight, Flush, Full House, 4 of a Kind, Straight Flush, 5 of a Kind or Royal Flush; and this wager loses if the Player's best 5-card poker hand is not one of the above winning hands. Pair Of Kings Or Better Bet pays Even Money (1 to 1) on any one of the above winning hands.

TWO PAIR OR BETTER BET: A Player's Two Pair Or Better Bet wager wins if the Player's best 5-card poker hand is a 8-high hand, Two Pair, 3 of a Kind, Straight, Flush, Full House, 4 of a Kind, Straight Flush, 5 of a Kind or Royal Flush; and this wager loses if the Player's best 5-card poker hand is not one of the above winning hands. Two Pair Or Better Bet pays Even Money on any one of the above winning hands.

3 OF A KIND OR BETTER BET: A Player's 3 Of A Kind Or Better Bet wager wins if the Player's best 5-card poker hand is a 8-high hand, 3 of a Kind, Straight, Flush, Full House, 4 of a Kind, Straight Flush, 5 of a Kind or Royal Flush; and this wager loses if the Player's best 5-card poker hand is not one of the above winning hands. 3 Of A Kind Or Better Bet pays 3.5 to 1 on any one of the above winning hands. Alternatively, any other appropriate payout odds can be used.

STRAIGHT OR BETTER BET: A Player's Straight Or Better Bet wager wins if the Player's best 5-card poker hand is a 8-high hand, Straight, Flush, Full House, 4 of a Kind, Straight Flush, 5 of a Kind or Royal Flush; and this wager loses if the Player's best 5-card poker hand is not one of the above winning hands. Straight Or Better Bet pays 5 to 1 on any one of the above winning hands.

FLUSH OR BETTER BET: A Player's Flush Or Better Bet wager wins if the Player's best 5-card poker hand is a 8-high hand, Flush, Full House, 4 of a Kind, Straight Flush, 5 of a Kind or Royal Flush; and this wager loses if the Player's best 5-card poker hand is not one of the above winning hands. Flush Or Better Bet pays 10 to 1 on any one of the above winning hands.

FULL HOUSE OR BETTER BET: A Player's Full House Or Better Bet wager wins if the Player's best 5-card poker hand is a 8-high hand, Full House, 4 of a Kind, Straight Flush, 5 of a Kind or Royal Flush; and this wager loses if the Player's best 5-card poker hand is not one of the above winning hands. Full House Or Better Bet pays 20 to 1 on any one of the above winning hands. Alternatively, any other appropriate payout odds can be used.

BONUS BET: Either one of the following games can be selected for the Bonus Bet game:

Game 1: A Player's Bonus Bet wager wins if the Player's best 5-card poker hand is a 8-high hand, 3 of a Kind, Straight, Flush, Full House, 4 of a Kind, Straight Flush, 5 of a Kind or Royal Flush; and the wager loses if the Player's best 5-card poker hand is not one of the above winning hands. The winning wager is paid according to the pay table below:

| Hand | Payout Odds |
|---|---|
| Royal Flush | 200 to 1 |
| 5 of a Kind | 80 to 1 |
| Straight Flush | 40 to 1 |
| 4 of a Kind | 20 to 1 |
| Full House | 4 to 1 |
| Flush | 3 to 1 |
| Straight | 2 to 1 |
| 3 of a Kind | 2 to 1 |
| 8 High | 5 to 1 |

Game 2: A Player's Bonus Bet wager wins if the Player's best 5-card poker hand is a 8-high hand, Straight, Flush, Full House, 4 of a Kind, Straight Flush, 5 of a Kind or Royal Flush; and the wager loses if the Player's best 5-card poker hand is not one of the above winning hands. The winning wager is paid according to the pay table below:

| Hand | Payout Odds |
|---|---|
| Royal Flush | 200 to 1 |
| 5 of a Kind | 100 to 1 |
| Straight Flush | 50 to 1 |
| 4 of a Kind | 25 to 1 |
| Full House | 4 to 1 |
| Flush | 3 to 1 |
| Straight | 2 to 1 |
| 8 High | 5 to 1 |

Game 3: A Player's Bonus Bet wager wins if the Player's best 5-card poker hand is a 8-high hand, Flush, Full House, 4 of a Kind, Straight Flush, 5 of a Kind or Royal Flush; and the wager loses if the Player's best 5-card poker hand is not one of the above winning hands. The winning wager is paid according to the pay table below:

| Hand | Payout Odds |
|---|---|
| Royal Flush | 200 to 1 |
| 5 of a Kind | 100 to 1 |
| Straight Flush | 50 to 1 |
| 4 of a Kind | 25 to 1 |
| Full House | 6 to 1 |
| Flush | 3 to 1 |
| 8 High | 5 to 1 |

Once having delivered the cards to all players, the dealer turns over the Banker's six cards with only the top card exposed. After reading their cards, each Player places his or her cards face down on the appropriate spaces of the table layout. The dealer then reveals the Banker's five remaining cards, settles each Player's side-bet wager(s) first if any, and then the Player's Poker Bet wager if any, against the Banker.

DETAILED DESCRIPTION OF THE INVENTION

Figure 1:
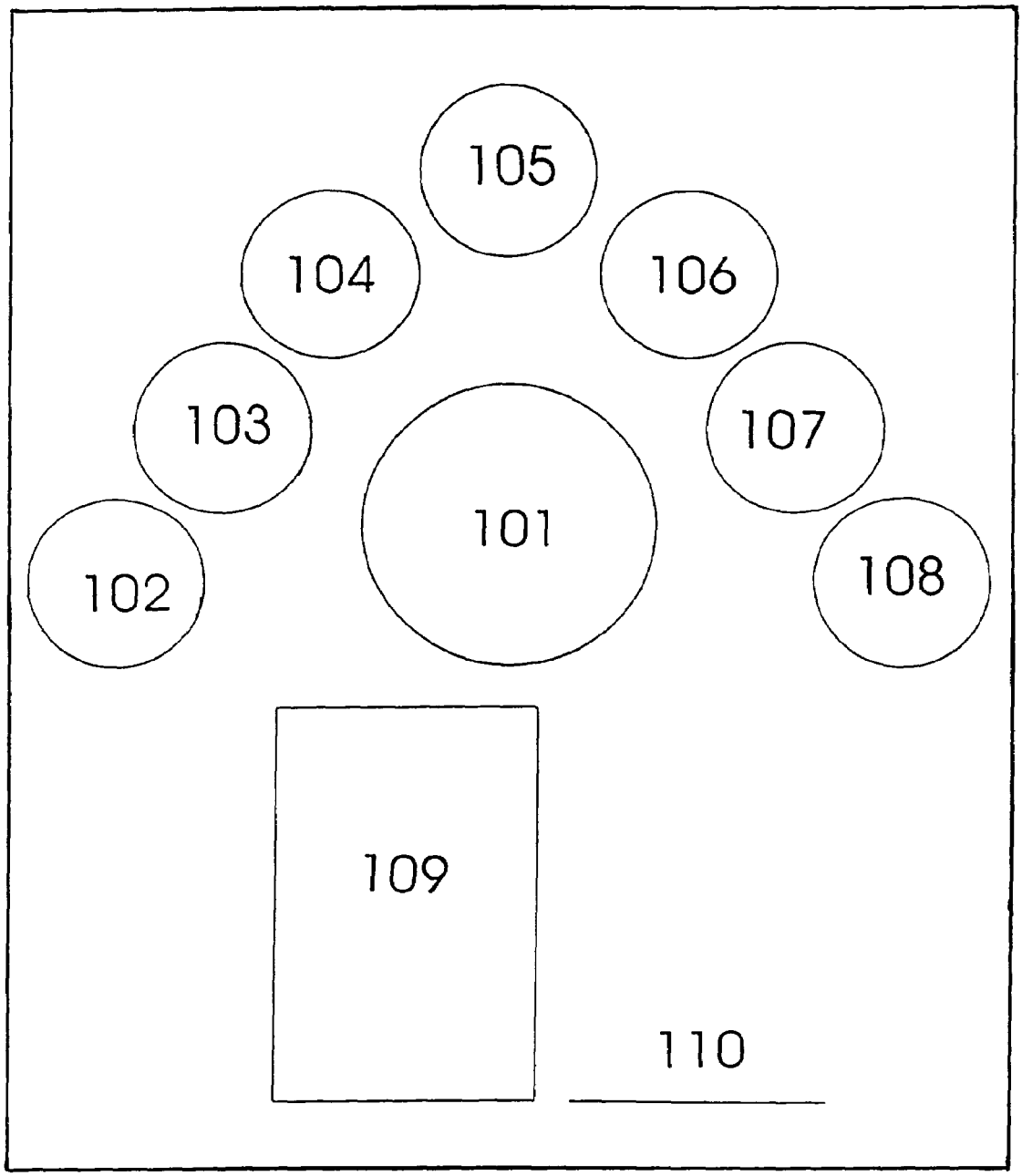
FIG. 1 shows a Player's betting area of the table layout of the eight-bet version of the invention: 101 is Poker Bet spot; 102, Pair Of Kings Or Better Bet spot; 103, Two Pair Or Better Bet spot; 104, 3 Of A Kind Or Better Bet spot; 105, Straight Or Better Bet spot; 106, Flush Or Better Bet spot; 107, Full House Or Better Bet spot; 108, Bonus Bet spot; 109, a Player's best 5-card poker hand space; and 110, a Player's one discard space.
Figure 2:
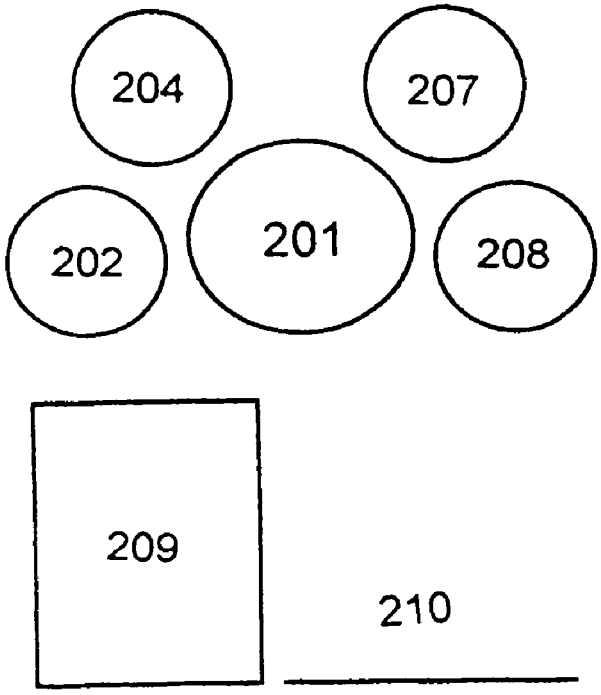
FIG. 2 shows a Player's betting area of the table layout of the five-bet version of the invention: 201 is Poker Bet spot; 202, Pair Of Kings Or Better Bet spot; 204, 3 Of A Kind Or Better Bet spot; 207, Full House Or Better Bet spot; 208, Bonus Bet spot, 209, a Player's best 5-card poker hand space; 210, a Player's one discard space.
Figure 3:
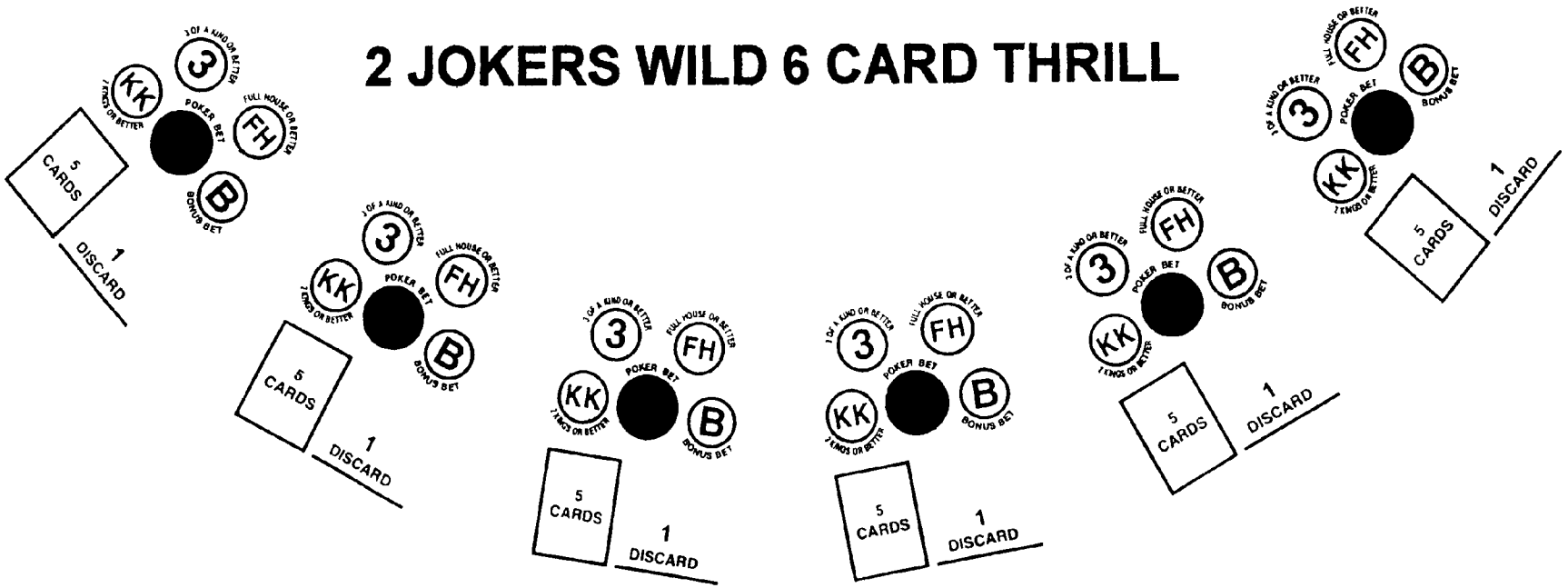
FIG. 3 shows the table layout of a five-bet version of the invention.

In the preferred embodiment of the invention provides a six-card stud poker game, played with one standard poker deck of 52 cards plus two Jokers. In other embodiments, the invention includes versions that would be played with at least one standard poker decks of 52 cards plus at least one Joker. In an embodiment, the invention is played with least one standard poker deck of 52, wherein either all Twos, all Threes, all Fours, all Fives, all Sixes, all Sevens, all Eights, all Nines, all Tens, all Jacks, all Queens, all Kings, or all Aces are Wild Cards.

In the preferred embodiment, each Joker or each Wild Card can be used as any card. In an embodiment each Joker can be used as an Ace, or to form a Straight or Flush; this version alters the odds, the payout, and the house advantage of each type of bet, and excludes the rankings of 5 Twos through 5 Kings from the rankings of the Poker Bet game in the preferred embodiment.

In the preferred embodiment, the invention offers seven positions, six Players and one Banker; table size, management of players, players' bets, and speed of play are the key reasons for the choice of seven positions. In other embodiments, lesser or greater than seven positions can be created in accordance with this invention if, for example, multiple decks are used. A Player who is not a Banker may play Poker Bet playing against the Banker's hand and/or one or more side bets betting on the contents of the Player's own hand.

After at least one wager is placed, each Player and the Banker are each dealt six cards. In the preferred embodiment, each Player and the Banker each receives his or her own six dealt cards, starting from the Player sitting to the immediate left of the dealer, continuing in a clockwise fashion and ending with the Banker. Cards are preferably dealt to each Player and to the Banker one card at a time for six times if the cards are shuffled by a dealer; the cards are preferably dealt to each Player and to the Banker in a stack of six cards if the cards are shuffled by a shuffling device. In an embodiment, seven hands of six cards are always dealt, regardless of the actual number of players; and some random number generation device such as a random number generator or a dice shaker, is used to assign the dealt hands to players to reduce the likelihood of problems in dealing. In other embodiments, each Player and the Banker may receive their hand in either one of the following fashions, whichever is selected for the game:

1. They receive their own five cards and one community card.
2. They receive their own four cards and two community cards.
3. They receive their own three cards and three community cards.
4. They receive their own two cards and four community cards.
5. They receive their own one card and five community cards. And
6. They receive no card their own and six community cards.

POKER BET is a bet that allows a Player to place a wager playing against the Banker's hand. The object of Poker Bet game is to have a best 5-card poker hand that ranks the same as or higher than the Banker's best 5-card poker hand. In the game, the Player's best 5-card poker hand is compared to the Banker's best 5-card poker hand according to traditional poker rankings, wherein hands are ranked in descending order as follows: Royal Flush, 5 of a Kind, Straight Flush, 4 of a Kind, Full House, Flush, Straight, 3 of a Kind, Two Pair, One Pair and High Card. Ace is the highest High Card, following by King, Queen, Jack, Ten, 9, 8, 7, 6, 5, 4, 3 and 2. A2345 is the lowest Straight.

Poker Bet wager can be settled with either one of the following rules, whichever is selected for the game:

Rules 1: If the Player is dealt a 6-card Straight Flush or a 6-card 8 high hand (i.e., a hand consists of six cards 8, 7, 6, 5, 3 and 2, or 8, 7, 6, 4, 3 and 2, or 8, 7, 5, 4, 3 and 2), the Player's wager wins Even Money (1 to 1) regardless of the Banker's hand. If the Player is not dealt a 6-card Straight Flush or a 6-card 8 high hand, then the Player's wager is settled as follows: if the Player's best 5-card poker hand ranks the same as or higher than the Banker's best 5-card poker hand, then the Player's wager wins and, either is paid Even Money (1 to 1) if the Banker's losing hand is not King-Jack or lower or is paid one half of the wager (1 to 2) if the Banker's losing hand is King-Jack or lower; if the Player's best 5-card poker hand ranks lower than the Banker's, the Player's Poker Bet wager loses.

Rules 2: If the Player is dealt a 6-card Straight Flush or a 6-card 8 high hand, the Player's wager wins Even Money (1 to 1) regardless of the Banker's hand. If the Player is not dealt a 6-card Straight Flush or a 6-card 8 high hand, then the Player's wager is settled as follows: if the Player's best 5-card poker hand ranks the same as or higher than the Banker's best 5-card poker hand, then the Player's wager wins and, either is paid Even Money (1 to 1) if the Banker's losing hand is not one of the predetermined hands that pays the Player's winning hand one half of the wager or is paid one half of the wager (1 to 2) if the Banker's losing hand is one of the predetermined hands that pays the Player winning hand one half of the wager; if the Player's best 5-card poker hand ranks lower than the Banker's, the Player's Poker Bet wager loses.

Rules 3: If the Player is dealt a 6-card Straight Flush or a 6-card 8 high hand the Player's wager wins Even Money (1 to 1) regardless of the Banker's hand. If the Player is not dealt a 6-card Straight Flush or a 6-card 8 high hand, then the Player's wager is settled as follows: if the Player's best 5-card poker hand ranks the same as or higher than the Banker's best 5-card poker hand, then the Player's wager wins and is paid Even Money (1 to 1) less a specified percent of commission; if the Player's best 5-card poker hand ranks lower than the Banker's, this wager loses.

Rules 4: If the Player is dealt a 6-card Straight Flush or a 6-card 8 high hand the Player's wager wins Even Money (1 to 1) regardless of the Banker's hand. If the Player is not dealt a 6-card Straight Flush or a 6-card 8 high hand, then the Player's wager is settled as follows: if the Player's best 5-card poker hand ranks the same as or higher than the Banker's best 5-card poker hand, then the Player's wager wins and is paid Even Money (1 to 1) less a 5% commission; if the Player's best 5-card poker hand ranks lower than the Banker's, this wager loses.

Rules 5: If the Player is dealt a 6-card Straight Flush or a 6-card 8 high hand the Player's wager wins Even Money (1 to 1) regardless of the Banker's hand. If the Player is not dealt a 6-card Straight Flush or a 6-card 8 high hand, then the Player's wager is settled as follows: if the Banker's best 5-card poker hand is 'not' one of predetermined qualifying hands, the Player's wager is a tie and the Player's wager neither wins nor loses; if the Player's best 5-card poker hand ranks the same as or higher than the Banker's best 5-card poker hand and the Banker's best 5-card poker hand is one of the predetermined qualifying hands, then the Player's wager wins and is paid Even Money (1 to 1); and if the Player's best 5-card poker hand ranks lower than the Banker's and the Banker's best 5-card poker hand is one of the predetermined qualifying hands, this wager loses.

Rules 6: If the Player is dealt a 6-card Straight Flush or a 6-card 8 high hand the Player's wager wins Even Money (1 to 1) regardless of the Banker's hand. If the Player is not dealt a 6-card Straight Flush or a 6-card 8 high hand, then the Player's wager is settled as follows: if the Player's best 5-card poker hand ranks the same as or higher than the Banker's and the Banker's best 5-card poker hand is one of the predetermined qualifying hands, this wager wins and is paid Even Money (1 to 1); if the Player's best 5-card poker hand ranks the same as or higher than the Banker's, the Banker's best 5-card poker hand is 'not' one of predetermined qualifying hands, then the Player's wager wins and is paid one half of the wager; if the Player's best 5-card poker hand ranks lower than the Banker's and the Banker's best 5-card poker hand is one of the predetermined qualifying hands, the Player's wager loses THE SIDE BETS OF THE INVENTION: Side Bets are bets that allow Players to bet on the contents of their own hand. A Player's side-bet wager wins if the Player's best 5-card poker hand is one of the predetermined winning hands of the type of side bet he or she bets on, regardless of the outcome of the Poker Bet wager or the Banker's hand; and this wager loses if the Player's best 5-card poker hand is not one of the predetermined winning hands. There are seven side bets and they are: Pair of Kings Or Better Bet, Two Pair Or Better Bet, 3 Of A Kind Or Better Bet, Straight Or Better Bet, Flush Or Better Bet, Full House Or Better Bet and Bonus Bet.

SPECIFIED PAIR OR BETTER BET: The specified pair can be any pair. If the specified pair is a pair of Tens, then the name of the bet can be called as Pair Of Tens Or Better Bet; if the Specified Pair is a pair of Queens, then the name of the bet can be called as Pair Of Queens Or Better Bet; and so on. A Player's Specified Pair Or Better Bet wager wins if the Player's best 5-card poker hand is a 8-high hand, the specified pair, any pair that ranks higher than the specified pair, Two Pair, 3 of a Kind, Straight, Flush, Full House, 4 of a Kind, Straight Flush, 5 of a Kind or Royal Flush; and the wager loses if the Player's best 5-card poker hand is not one of the above winning hands. The Specified Pair Or Better Bet pays Even Money (1 to 1) on any one of the above winning hands. Alternatively, any other appropriate payout odds can be used.

PAIR OF KINGS OR BETTER BET: A Player's Pair Of Kings Or Better Bet wager wins if the Player's best 5-card poker hand is a 8-high hand, a pair of Kings, a pair of Aces, Two Pair, 3 of a Kind, Straight, Flush, Full House, 4 of a Kind, Straight Flush, 5 of a Kind or Royal Flush; and this wager loses if the Player's best 5-card poker hand is not one of the above winning hands. Pair Of Kings Or Better Bet pays Even Money (1 to 1) on any one of the above winning hands. Alternatively, any other appropriate payout odds can be used.

TWO PAIR OR BETTER BET: A Player's Two Pair Or Better Bet wager wins if the Player's best 5-card poker hand is a 8-high hand, Two Pair, 3 of a Kind, Straight, Flush, Full House, 4 of a Kind, Straight Flush, 5 of a Kind or Royal Flush; and this wager loses if the Player's best 5-card poker hand is not one of the above winning hands. Two Pair Or Better Bet pays Even Money on any one of the above winning hands. Alternatively, any other appropriate payout odds can be used.

3 OF A KIND OR BETTER BET: A Player's 3 Of A Kind Or Better Bet wager wins if the Player's best 5-card poker hand is a 8-high hand, 3 of a Kind, Straight, Flush, Full House, 4 of a Kind, Straight Flush, 5 of a Kind or Royal Flush; and this wager loses if the Player's best 5-card poker hand is not one of the above winning hands. 3 Of A Kind Or Better Bet pays 3.5 to 1 on any one of the above winning hands. Alternatively, any other appropriate payout odds can be used.

STRAIGHT OR BETTER BET: A Player's Straight Or Better Bet wager wins if the Player's best 5-card poker hand is a 8-high hand, Straight, Flush, Full House, 4 of a Kind, Straight Flush, 5 of a Kind or Royal Flush; and this wager loses if the Player's best 5-card poker hand is not one of the above winning hands. Straight Or Better Bet pays 5 to 1 on any one of the above winning hands. Alternatively, any other appropriate payout odds can be used.

FLUSH OR BETTER BET: A Player's Flush Or Better Bet wager wins if the Player's best 5-card poker hand is a 8-high hand, Flush, Full House, 4 of a Kind, Straight Flush, 5 of a Kind or Royal Flush; and this wager loses if the Player's best 5-card poker hand is not one of the above winning hands. Flush Or Better Bet pays 10 to 1 on any one of the above winning hands. Alternatively, any other appropriate payout odds can be used.

FULL HOUSE OR BETTER BET: A Player's Full House Or Better Bet wager wins if the Player's best 5-card poker hand is a 8-high hand, Full House, 4 of a Kind, Straight Flush, 5 of a Kind or Royal Flush; and this wager loses if the Player's best 5-card poker hand is not one of the above winning hands. Full House Or Better Bet pays 20 to 1 on any one of the above winning hands. Alternatively, any other appropriate payout odds or any appropriate pay table can be used.

BONUS BET: Either one of the following games can be selected for the Bonus Bet game:

Game 1: A Player's Bonus Bet wager wins if the Player's best 5-card poker hand is a 8-high hand, 3 of a Kind, Straight, Flush, Full House, 4 of a Kind, Straight Flush, 5 of a Kind or Royal Flush; and the wager loses if the Player's best 5-card poker hand is not one of the above winning hands. The winning wager is paid according to the pay table below:

| Hand | Payout Odds |
|---|---|
| Royal Flush | 200 to 1 |
| 5 of a Kind | 80 to 1 |
| Straight Flush | 40 to 1 |
| 4 of a Kind | 20 to 1 |
| Full House | 4 to 1 |
| Flush | 3 to 1 |
| Straight | 2 to 1 |
| 3 of a Kind | 2 to 1 |
| 8 High | 5 to 1 |

Alternatively, any other appropriate pay table can be used.

Game 2: A Player's Bonus Bet wager wins if the Player's best 5-card poker hand is a 8-high hand, Straight, Flush, Full House, 4 of a Kind, Straight Flush, 5 of a Kind or Royal Flush; and the wager loses if the Player's best 5-card poker hand is not one of the above winning hands. The winning wager is paid according to the pay table below:

| Hand | Payout Odds |
|---|---|
| Royal Flush | 200 to 1 |
| 5 of a Kind | 100 to 1 |
| Straight Flush | 50 to 1 |
| 4 of a Kind | 25 to 1 |
| Full House | 4 to 1 |
| Flush | 3 to 1 |
| Straight | 2 to 1 |
| 8 High | 5 to 1 |

Alternatively, any other appropriate pay table can be used.

Game 3: A Player's Bonus Bet wager wins if the Player's best 5-card poker hand is a 8-high hand, Flush, Full House, 4 of a Kind, Straight Flush, 5 of a Kind or Royal Flush; and the wager loses if the Player's best 5-card poker hand is not one of the above winning hands. The winning wager is paid according to the pay table below:

| Hand | Payout Odds |
|---|---|
| Royal Flush | 200 to 1 |
| 5 of a Kind | 100 to 1 |
| Straight Flush | 50 to 1 |
| 4 of a Kind | 25 to 1 |
| Full House | 6 to 1 |
| Flush | 3 to 1 |
| 8 High | 5 to 1 |

Alternatively, any other appropriate pay table can be used.

Once having delivered the cards to all players, the dealer turns over the Banker's six cards with only the top card exposed. From each Player's own six cards, each Player selects and keeps his or her best 5-card poker hand and discards one other card, then each Player places his or her cards on the appropriate spaces of the table layout. The dealer then reveals the Banker's five remaining cards, selects and keeps the Banker's best 5-card poker hand, discards one other card, settles each Player's side-bet wager(s) first if any, and then each Player's Poker Bet wager if any, against the Banker. After completing the transaction of the Player at the immediate right of the dealer, the dealer moves on and completes the transaction of the next Player, and so on. Upon the completion of all transactions, a new round of play will begin.

Creating Other Versions of 2 Jokers Wild 6 Card Thrill

The games of Poker Bet and 7 side bets are the subgames of 6 Card Thrill. There are many ways to create other versions of 6 Card Thrill and they are:

1. 6 Card Thrill consists of the game of Poker Bet only.
2. 6 Card Thrill consists of the games of Poker Bet and any one of the side bets.
3. 6 Card Thrill consists of the games of Poker Bet and any two of the side bets.
4. 6 Card Thrill consists of the games of Poker Bet and any three of the side bets.
5. 6 Card Thrill consists of the games of Poker Bet and any four of the side bets.
6. 6 Card Thrill consists of the games of Poker Bet and any six of the side bets.
7. 6 Card Thrill consists of the game of any one of the side bets.
8. 6 Card Thrill consists of the games of any two of the side bets.
9. 6 Card Thrill consists of the games of any three of the side bets.
10. 6 Card Thrill consists of the games of any four of the side bets.
11. 6 Card Thrill consists of the games of any five of the side bets.
12. 6 Card Thrill consists of the games of any six of the side bets. And
13. 6 Card Thrill consists of the games of all the side bets.

What is claimed is:

1. A method of playing a card game among a plurality of Players and a Banker, each Player wagering against the Banker and the method comprising the following steps:

(a) providing and shuffling at least one standard poker deck of 52 cards plus at least one Joker;

(b) each Player placing at least one wager of Poker Bet, Specified Pair Or Better Bet, Two Pair Or Better Bet, 3 Of A Kind Or Better Bet, Straight Or Better Bet, Flush Or Better Bet, Full House Or Better Bet and Bonus Bet;

(c) dealing cards into enough dealt hands of six cards to provide a dealt hand for each Player and for the Banker;

(d) determining which dealt hand is assigned to each Player and which dealt hand is assigned to the Banker;

(e) from their own six-card dealt hand, each Player and the Banker each selecting and keeping his or her best 5-card poker hand and discarding one other card;

(f) determining whether each Player's side-bet wager or wagers win or lose, if any;

(g) settling any side-bet wagers of each Player against the Banker;

(h) comparing each Player's best 5-card poker hand to the Banker's best 5-card poker hand according to the rankings selected for the Poker Bet game, wherein hands are ranked in descending order as follows: Royal Flush, 5 of a Kind, Straight Flush, 4 of a Kind, Full House, Flush, Straight, 3 of a Kind, Two Pair, One Pair and High Card; wherein Ace is the highest High Card, following by King, Queen, Jack, Ten, 9, 8, 7, 6, 5, 4, 3 and 2; wherein A2345 is the lowest Straight and that when it is suited, A2345 is the lowest Straight Flush;

(i) determining whether each Player's Poker Bet wager wins, loses or ties, if any;

(j) settling each Player's Poker Bet wager against the Banker, wherein a Player's Specified Pair Or Better Bet wager wins and is paid Even Money, namely 1 to 1, if the Player's best 5-card poker hand is a 8-high hand, the specified pair, any pair that ranks higher than the specified pair, Two Pair, 3 of a Kind, Straight, Flush, Full House, 4 of a Kind, Straight Flush, 5 of a Kind or Royal Flush; and the Player's wager loses if the Players best 5-card poker hand is not one of the aforesaid winning hands.

2. The method of playing a card game according to claim 1, wherein the card game of the invention uses one standard poker deck of 52 cards plus two Jokers.

3. The method of playing a card game according to claim 1, wherein each Joker may be used as any card.

4. The method of playing a card game according to claim 1, wherein a Player's Two Pair Or Better Bet wager wins and is paid Even Money, namely 1 to 1, if the Player's best 5-card poker hand is a 8-high hand, Two Pair, 3 of a Kind, Straight, Flush, Full House, 4 of a Kind, Straight Flush, 5 of a Kind or Royal Flush; the Player's wager loses if the Player's best 5-card poker hand is not one of the aforesaid winning hands.

5. The method of playing a card game according to claim 1, wherein a Player's 3 Of A Kind Or Better Bet wager wins and is paid at odds of 3.5 to 1 if the Player's best 5-card poker hand is a 8-high hand, 3 of a Kind, Straight, Flush, Full House, 4 of a Kind, Straight Flush, 5 of a Kind or Royal Flush; and the Player's wager loses if the Player's best 5-card poker hand is not one of the aforesaid winning hands.

6. The method of playing a card game according to claim 1, wherein a Player's Straight Or Better Bet wager wins and is paid at odds of 5 to 1 if a Player's best 5-card poker hand is a 8-high hand, Straight, Flush, Full House, 4 of a Kind, Straight Flush, 5 of a Kind or Royal Flush; and the Player's wager loses if the Player's best 5-card poker hand is not one of the aforesaid winning hands.

7. The method of playing a card game according to claim 1, wherein a Player's Flush Or Better Bet wager wins and is paid at odds of 10 to 1 if the Player's best 5-card poker hand is Flush, Full House, 4 of a Kind, Straight Flush, 5 of a Kind or Royal Flush; the Player's wager loses if the Player's best 5-card poker hand is not one of the aforesaid winning hands.

8. The method of playing a card game according to claim 1, wherein a Player's Full House Or Better Bet wager wins and is paid at odds of 20 to 1 if the Player's best 5-card poker hand is Full House, 4 of a Kind, Straight Flush, 5 of a Kind or Royal Flush; and the Player's wager loses if the Player's best 5-card poker hand is not one of the above winning hands.

9. The method of playing a card game according to claim 1, wherein a Player's Bonus Bet wager wins if the Player's best 5-card poker hand is a 8-high hand, 3 of a Kind, Straight, Flush, Full House, 4 of a Kind, Straight Flush, 5 of a Kind or Royal Flush; and the wager loses if the Player's best 5-card poker hand is not one of the above winning hands; the Player's winning wager is paid according to the pay table below:

| Hand | Payout Odds |
|---|---|
| Royal Flush | 200 to 1 |
| 5 of a Kind | 80 to 1 |
| Straight Flush | 40 to 1 |
| 4 of a Kind | 20 to 1 |
| Full House | 4 to 1 |
| Flush | 3 to 1 |
| Straight | 2 to 1 |
| 3 of a Kind | 2 to 1 |
| 8 High | 5 to 1. |

10. The method of playing a card game according to claim 1, wherein a Player's Bonus Bet wager wins if the Player's best 5-card poker hand is a 8-high hand, Straight, Flush, Full House, 4 of a Kind, Straight Flush, 5 of a Kind or Royal Flush; and the Player's wager loses if the Player's best 5-card poker hand is not one of the above winning hands; the Player's winning wager is paid according to the pay table below:

| Hand | Payout Odds |
|---|---|
| Royal Flush | 200 to 1 |
| 5 of a Kind | 100 to 1 |
| Straight Flush | 50 to 1 |

-continued

| Hand | Payout Odds |
|---|---|
| 4 of a Kind | 25 to 1 |
| Full House | 4 to 1 |
| Flush | 3 to 1 |
| Straight | 2 to 1 |
| 8 High | 5 to 1. |

11. The method of playing a card game according to claim 1, wherein a Player's Bonus Bet wager wins if the Player's best 5-card poker hand is a 8-high hand, Flush, Full House, 4 of a Kind, Straight Flush, 5 of a Kind or Royal Flush; and the Player's wager loses if the Player's best 5-card poker hand is not one of the above winning hands; the Player's winning wager is paid according to the pay table below:

| Hand | Payout Odds |
|---|---|
| Royal Flush | 200 to 1 |
| 5 of a Kind | 100 to 1 |
| Straight Flush | 50 to 1 |
| 4 of a Kind | 25 to 1 |
| Full House | 6 to 1 |
| Flush | 3 to 1 |
| 8 High | 5 to 1. |

12. The method of playing a card game according to claim 1, wherein if a Player is dealt a 6-card Straight Flush or a 6-card 8 high hand, the Player's Poker wager wins Even Money, namely 1 to 1, regardless of the Banker's hand; if the Player is not dealt a 6-card Straight Flush or a 6-card 8 high hand, then the Player's wager is settled as follows: if the Player's best 5-card poker hand ranks the same as or higher than the Banker's best 5-card poker hand, then the Player's wager wins and either is paid Even Money, namely 1 to 1, if the Banker's losing hand is not one of the predetermined hands that pays the Player's winning hand one half of the wager, or is paid one half of the wager, namely 1 to 2, if the Banker's losing hand is one of the predetermined hands that pays the Player winning hand one half of the wager; if the Player's best 5-card poker hand ranks lower than the Banker's, the Player's wager loses.

13. The method of playing a card game according to claim 1, wherein if a Player is dealt a 6-card Straight Flush or a 6-card 8 high hand, the Player's Poker Bet wager wins Even Money, namely 1 to 1, regardless of the Banker's hand; if the Player is not dealt a 6-card Straight Flush or a 6-card 8 high hand, then the Player's wager is settled as follows: if the Player's best 5-card poker hand ranks the same as or higher than the Banker's best 5-card poker hand, then the Player's wager wins and either is paid Even Money, namely 1 to 1, if the Banker's losing hand is not King-Jack or lower, or is paid one half of the wager, namely 1 to 2, if the Banker's losing hand is King-Jack or lower; if the Player's best 5-card poker hand ranks lower than the Banker's, the Player's wager loses.

14. The method of playing a card game according to claim 1, wherein if a Player is dealt a 6-card Straight Flush or a 6-card 8 high hand, the Player's Poker Bet wager wins Even Money, namely 1 to 1, regardless of the Banker's hand; if the Player is not dealt a 6-card Straight Flush or a 6-card 8 high hand, then the Player's wager is settled as follows: if the Player's best 5-card poker hand ranks the same as or higher than the Banker's best 5-card poker hand, then the Player's wager wins and is paid Even Money, namely 1 to 1, less a specified percent of commission; if the Player's best 5-card poker hand ranks lower than the Banker's, the Player's wager loses.

15. The method of playing a card game according to claim 14, wherein the specified percent of commission is 5%.

16. The method of playing a card game according to claim 1, wherein if a Player is dealt a 6-card Straight Flush or a 6-card 8 high hand, the Player's Poker Bet wager wins Even Money, 1 to 1, regardless of the Banker's hand; if the Player is not dealt a 6-card Straight Flush or a 6-card 8 high hand, then the Player's wager is settled as follows: if the Banker's best 5-card poker hand is not one of predetermined qualifying hands, the Player's wager is a tie and the Player's wager neither wins nor loses;, if the Player's best 5-card poker hand ranks the same as or higher than the Banker's best 5-card poker hand and the Banker's best 5-card poker hand is one of the predetermined qualifying hands, then the Player's wager wins and is paid Even Money, 1 to 1; and if the Player's best 5-card poker hand ranks lower than the Banker's and the Banker's best 5-card poker hand is one of the predetermined qualifying hands, the Player's wager loses.

17. The method of playing a card game according to claim 1, wherein if a Player is dealt a 6-card Straight Flush or a 6-card 8 high hand the Player's Poker Bet wager wins Even Money, 1 to 1, regardless of the Banker's hand; if the Player is not dealt a 6-card Straight Flush or a 6-card 8 high hand, then the Player's wager is settled as follows: if the Player's best 5-card poker hand ranks the same as or higher than the Banker's best 5-card poker hand and the Banker's best 5-card poker hand is not one of predetermined qualifying hands that pays the Player one half of the Player's winning wager, namely 1 to 2, this wager wins and is paid Even Money, 1 to 1; if the Player's best 5-card poker hand ranks the same as or higher than the Banker's, the Banker's best 5-card poker hand is one of the predetermined qualifying hands, then the Player's wager wins and is paid one half of the wager; if the Player's best 5-card poker hand ranks lower than the Banker's and the Banker's best 5-card poker hand is one of the predetermined qualifying hands, the Player's wager loses.

* * * * *